US006029884A

United States Patent [19]

Roeland

[11] Patent Number: 6,029,884

[45] Date of Patent: Feb. 29, 2000

[54] METHOD FOR CONSTRUCTING A STURDY, LIGHT-TIGHT PACKAGE AND A PACKAGE THEREOF

[75] Inventor: James F. Roeland, Lyons, N.Y.

[73] Assignee: Paul T. Trend Corporation, Palmyra, N.Y.

[21] Appl. No.: 09/084,666

[22] Filed: May 26, 1998

[51] Int. Cl.[7] ..... B65D 5/20; B65B 43/00

[52] U.S. Cl. ..... 229/125.19; 206/455; 206/813; 229/931; 229/939; 493/59; 493/102; 493/130; 493/131

[58] Field of Search ..... 229/125.19, 931, 229/939; 206/455, 813; 493/59–62, 69–72, 79–81, 102, 114, 130–132

[56] References Cited

U.S. PATENT DOCUMENTS

| | | | |
|---|---|---|---|
| 1,762,704 | 6/1930 | Smith | 229/931 |
| 2,197,152 | 4/1940 | Mason | 229/931 |
| 2,822,970 | 2/1958 | Froggatt et al. | 229/125.19 |
| 2,932,439 | 4/1960 | Sparling . | |
| 2,985,075 | 5/1961 | Knutsson-Hall . | |
| 3,654,053 | 4/1972 | Toedter . | |
| 3,926,362 | 12/1975 | Beck et al. | 229/125.19 |
| 4,984,688 | 1/1991 | Mikulin | 206/455 |
| 5,156,584 | 10/1992 | Cohen et al. | 493/59 |
| 5,337,916 | 8/1994 | Voss . | |
| 5,427,309 | 6/1995 | Voss . | |

*Primary Examiner*—Gary E. Elkins
*Attorney, Agent, or Firm*—Nixon Peabody LLP

[57] ABSTRACT

A method box for making a sturdy and light-tight box and a box thereof in accordance with one embodiment of the present invention includes providing a sheet of material with a first pair of opposing edges and a second pair of opposing edges. The sheet of material is grooved to form first and second pairs of grooves. Each of the first pair of grooves is spaced from one of the first pair of edges to form a first pair of sides and each of the second pair of grooves is spaced from one of the second pair of edges to form a second pair of sides. Next, the first and second pairs of sides are folded up along the first and second pair of grooves and then are secured together to form the box. The method may include additional steps, such as trimming the sheet of material to form the first and second pair of edges, where the steps of trimming and grooving are done in the same step, applying a non-translucent adhesive along each of the first and second pair of grooves to secure the first and second sides of the box together, applying a first layer of material over the first and second opposing edges, and/or cutting the grooves in to the sheet of material at an angle which is greater than the angle at which each of the first and second pairs of sides are located with respect to a base of the box when finished.

35 Claims, 6 Drawing Sheets

METHOD FOR CONSTRUCTING A STURDY, LIGHT-TIGHT PACKAGE AND A PACKAGE THEREOF

FIELD OF THE INVENTION

This invention relates generally to packages or boxes and, more particularly, to a method for making a sturdy and light-tight package and a package thereof.

BACKGROUND OF THE INVENTION

Packages or boxes are used for a variety of different types of applications, such as the display of merchandise for sale, the storage of goods or documents, and the transport of goods. Each application imposes different requirements on the package, such as the size, strength, durability, aesthetics, and sealing or light-tight capabilities of the package. For example, the storage of some materials, such as photographic films, requires a sturdy and light tight package.

One prior method for making a sturdy and light tight package uses sheets of chip board to construct the box. Although packages made from chip board are relatively sturdy and light-tight, the packages are heavy and thus difficult to lift and use. Although corrugated paper board is lighter and would provide sufficient strength and rigidity, typically corrugated paper board has not been used to form these types of packages because it is difficult to work with. More specifically, it is difficult to cut corrugated paper board cleanly and when it is cut it leaves open exposed fluting which can be easily frayed and damaged and is not aesthetically pleasing.

Another prior method uses corrugated paper board for making sturdy and light tight packages. This method cuts either a pair of grooves or a groove and a dado through the inner liner and filler, but not through the outer liner and near each edge of the corrugated paper board. Next, the sides of the corrugated paper board adjacent each edge are folded in on top of each other to double-up the size of each side wall and to seal the exposed fluting with the floor of the box. Some examples of methods similar to this are disclosed in U.S. Pat. No. 5,337,916 to Voss and U.S. Pat. No. 5,427,309 to Voss, which are herein incorporated by reference. Although this method results in a lighter package, this method and the resulting package have several problems.

One problem with this method and the resulting package or box is that the dimensions of the sides of the box may be imprecise resulting in a box that is misshapen, not light-tight, and/or not aesthetically pleasing. With this method, the corrugated paper board is simply loaded in to a machine to cut the grooves or the groove and dado. However, if the initial dimensions of each corrugated paper board are not precisely the same and/or if the corrugated paper board is simply misaligned when it is loaded into the machine then the dimensions of each side may vary from box to box. When the sides of the box between the grooves or the groove and dado vary, they will not fold in upon themselves properly or consistently. As a result, if the sides are off, the box will be misshapen and thus may not be sufficiently light tight and may not have an aesthetically pleasing or finished appearance.

Another problem with this method and the resulting box is that the manufacturing steps are difficult and time consuming. The method requires two difficult cuts, either two grooves or a groove and a dado, to be made near each edge of the corrugated paper board. As discussed earlier, cutting corrugated paper board is a difficult process, particularly when the cut must be controlled to extend through the inner liner and filler, but not through the outer liner of the corrugated paper board.

Yet another problem with this method and the resulting box is that the internal volume of the box is reduced when compared to packages or boxes of similar outer dimensions. This method requires the sides of the box to be folded in upon themselves which doubles up the walls of the box and unnecessarily reduces the internal volume of the box.

SUMMARY OF THE INVENTION

A method for making a sturdy and light-tight box in accordance with one embodiment of the present invention includes providing a sheet of material with a first pair of opposing edges and a second pair of opposing edges. The sheet of material is grooved to form first and second pairs of grooves. Each of the first pair of grooves is spaced from one of the first pair of edges to form a first pair of sides and each of the second pair of grooves is spaced from one of the second pair of edges to form a second pair of sides. Next, the first and second pairs of sides are folded up along the first and second pair of grooves and then are secured together to form the box. The method may include additional steps, such as trimming the sheet of material to form the first and second pair of edges, where the steps of trimming and grooving are done in the same step, applying a non-translucent adhesive along each of the first and second pair of grooves to secure the first and second sides of the box together, applying a first layer of material over the first and second opposing edges, and/or cutting the grooves in to the sheet of material at an angle which is greater than the angle at which each of the first and second pairs of sides are located with respect to a base of the box when finished.

A sturdy and light-tight box in accordance with one embodiment of the present invention includes a sheet of material with a first pair of opposing edges and a second pair of opposing edges. The sheet of material also has first and second pairs of grooves in the sheet of material. Each of the first pair of grooves is spaced from one of the first pair of opposing edges to form a first pair of opposing sides and each of the second pair of grooves is spaced from one of the second pair of opposing edges to form a second pair of opposing sides. The box may include a non-translucent adhesive which is located in the first and second pair of grooves and is used to hold the folded first and second pairs of opposing sides together to form the box and/or a first layer of material located over the first and second opposing edges. Alternatively, the box may have the first and second pairs of sides positioned at an angle with respect to a base defined between the first and second pairs of grooves which is less than the angle at which the first and second pair of grooves are cut.

The method of making the box and the box in accordance with the present invention provides a number of advantages including providing a box which is made to precise dimensions each time the box is made because the edges of each corrugated paper board are trimmed in the same step as the grooves are formed. By trimming the edges in the same step as cutting the grooves, there is no need to worry whether or not the sheets of corrugated paper board being used to form the boxes all have precisely the same starting dimensions or whether the sheets of corrugated paper board are properly aligned when loaded into the machine which cuts the grooves. By cutting and grooving the box to precise dimensions in the same step, the box can be made light-tight with an aesthetically pleasing and high quality finished appearance. Many customers of box manufacturers demand a high quality finish for their boxes because the quality of the box which stores their goods provides a perception to their customers about the quality of the goods in the box.

Another advantage of the present invention is that it provides a method which uses less complicated steps to be manufactured then prior methods. As discussed earlier, the step of cutting a groove or a dado into a sheet of corrugated paper board is difficult. Unlike one of the prior methods which required two sets of grooves or a groove and a dado to be cut in near each edge of the sheet of material, the present invention is much simpler because it only requires one groove to be cut near each edge and then the comparatively easy step of applying one or more layers of material over each of the edges to seal the edges and provide further strength and rigidity to the box. As a result, the method in accordance with the present invention is easier to carry out.

The present invention also provides a box with a larger internal, storage volume, than prior boxes of similar outer dimensions, while still providing sufficient rigidity and strength. Unlike prior boxes, which have unnecessarily thick side walls resulting from the sheet of material being folded in upon itself, the present invention does not double up the size of the side walls of the box and thus increases the internal volume and storage space of the box.

Further, the present invention provides a more light-tight box by using an adhesive which is non-translucent, preferably tinted with a dark color such as black. The adhesive helps to prevent any light from seeping into the box through areas of the sheet material that have been cut and thus might be more susceptible to allow light to seep through.

Even further, the present invention cuts the grooves in to the sheet of material at an angle which is greater than the angle of each of the first and second pairs of sides with respect to a base of the box when finished. The larger angle for the first and second pairs of grooves compensates for the space that the adhesive occupies when applied. This provides for a more precisely finished box and provides for a more light tight fit when the box has a lid in which the box nests.

DETAILED DESCRIPTION

Figure 1:
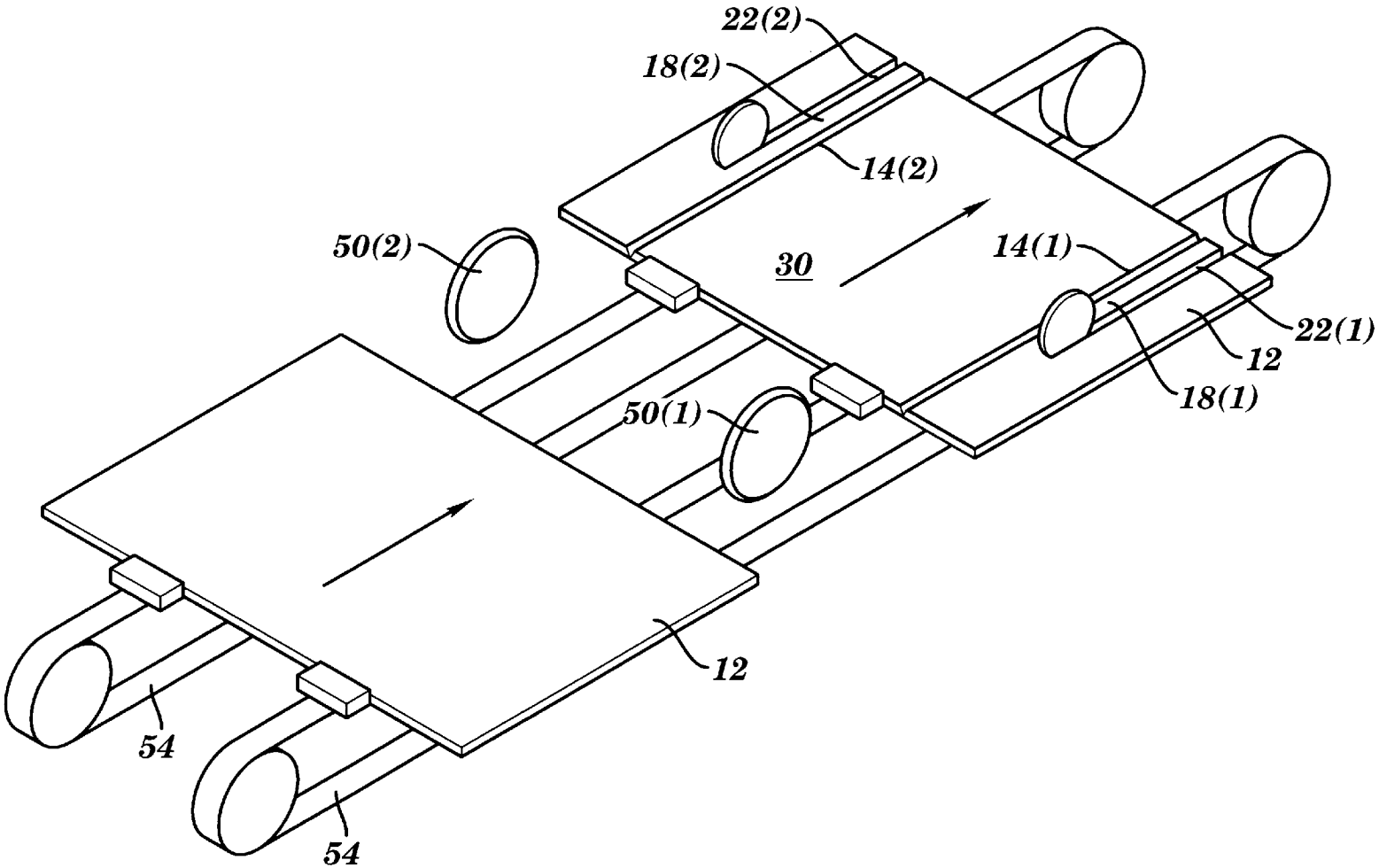
FIG. 1 is a perspective view of a grooving and trimming step in accordance with one embodiment of the present invention.

A method for making a sturdy and light-tight package or box and the resulting package 10 in accordance with one embodiment of the present invention is illustrated in FIGS. 1–6. The method includes the steps of providing a sheet of material 12, forming first and second pairs of grooves 14(1), 14(2), 16(1), and 16(2), folding first and second sides 18(1), 18(2), 20(1), and 20(2) up along the first and second pair of grooves 14(1), 14(2), 16(1), and 16(2) and securing them together to form the box 21. The method may include additional steps such as trimming the sheet of material 12 to form the first and second pair of edges 22(1), 22(2), 24(1), and 24(2), where the steps of trimming, and grooving are done in the same step, applying a non-translucent adhesive 26 along each of the first and second pair of grooves 14(1), 14(2), 16(1), and 16(2), applying a first layer of material 28 over the first and second opposing edges 22(1), 22(2), 24(1), and 24(2), and/or cutting the grooves 14(1), 14(2), 16(1), and 16(2) in to the sheet of material 12 at an angle which is greater than the angle at which each of first and second pairs of sides 18(1), 18(2), 20(1), and 20(2) are located with respect to a base 30 of the box 21 when finished. The package 10 includes a sheet of material 12 with first and second pairs of grooves 14(1), 14(2), 16(1), and 16(2) and may include a non-translucent adhesive 26 which is located in the first and second pair of grooves 14(1), 14(2), 16(1), and 16(2) and is used to hold the folded first and second pairs of opposing sides 18(1), 18(2), 20(1), and 20(2) together to form the box 21, a first layer of material 28 located over the first and second opposing edges 22(1), 22(2), 24(1), and 24(2), and/or the bottom, outside corners of the first and second pairs of grooves 14(1), 14(2), 16(1), and 16(2) which are cut at an angle which is greater than the angle of each of the folded first and second pairs of sides 18(1), 18(2), 20(1), and 20(2) with respect to base 30. The method of making the package and the resulting package 10 provide a number of advantages including providing a method which makes a package 10 with precise dimensions and uses less complicated steps to be manufactured and a box 21 which has precise dimensions, that is light-tight, aesthetically pleasing and has a larger internal, storage volume, than prior boxes of similar outer dimensions.

Referring to FIGS. 1–6, a package 10 with a box or base 21 or tray and a lid or cover 32 in accordance with one embodiment of the present invention is illustrated. Although one type of package 10 is shown with a box 21 and a lid 32, other types of packages, such as just a box, can be made as needed or desired. Since the box 21 and the lid 32 along with the method for making the box 21 or lid 32 are the same, except that the lid 32 has different dimensions, i.e. the lid 32 has slightly larger dimensions so that the box 21 nests within the lid 32 and may have shorter side walls then the box 21, the method of making the lid and the lid 32 will not be described in detail here. In this particular embodiment, the box 21 and lid 32 are designed and manufactured to fit together when closed to form a tight fit so as to make the package 10 'light-tight' when closed. Light-tight packages are intended for use for light sensitive applications, such as the shipment of light sensitive photographic film in various sheeted sizes and stack heights.

Referring to FIG. 1, to make the box 21, first a sheet of material 12, in this particular embodiment double-walled corrugated paper board, is provided, although other types of materials, such as single wall corrugated paper board, could be used as needed or desired. More specifically, in this particular embodiment, the sheet of material 12 is Kraft

56-36-56-36-56 Double Wall B/C Flute 400# corrugated paper board which has an outer layer 34 of Kraft liner at 56#/MSF (lb. per 1000 square feet), a first filler 36 of corrugated semi-chemical pulp at 36#/MSF, an intermediate layer 38 of Kraft liner at 56#/MSF, a second filler 40 of corrugated of semi-chemical pulp at 36#/MSF, and an inner layer 42 of Kraft liner at 56#/MSF. The corrugated dimensions for the first filler 36 for the flute in this material are 50±3 per inch at 3/32" in height, and for the second filler 40 for the flute in this material are 42±3 per inch at 9/64" in height. In this particular example, the sheet of material 12 must adhere to the following structural strength specifications: puncture resistance per DIN 53124—19J (J=10.2 kpcm); edge crushing per DIN 5311—18/km/m; and Cobb value per DIN 53132—130 g,/sq. meter for 30 minutes moisture—glue with resin additive, although these requirements for the sheet of material 12 can vary depending upon the particular packaging application.

Figure 2A:
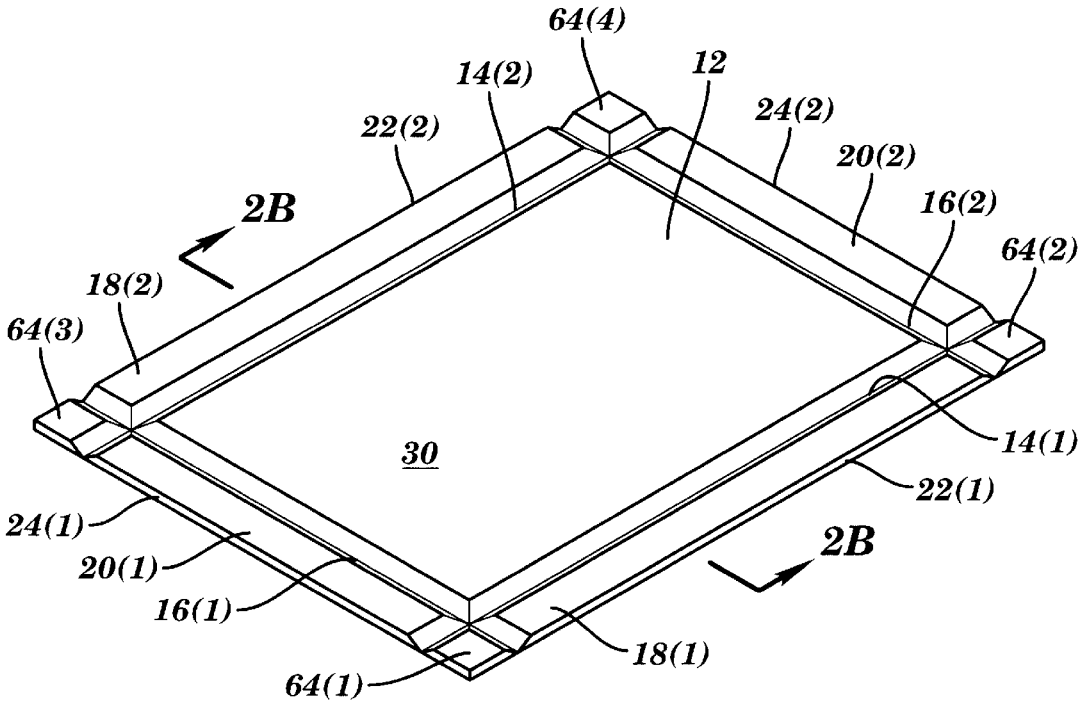
FIG. 2A is a perspective view of a sheet of material after the grooving and trimming steps.
Figure 2B:
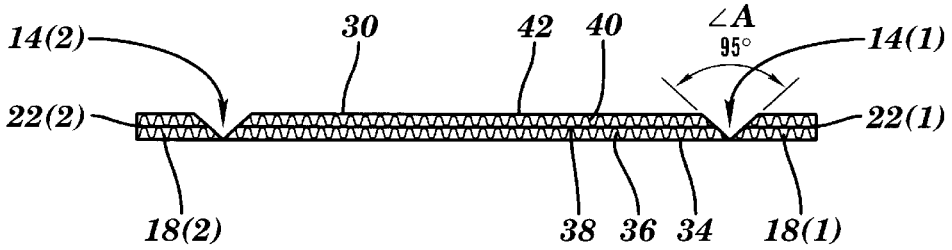
FIG. 2B is a cross-sectional view of the sheet of material shown in FIG. 2A taken along line 2B—2B.
Figure 4A:
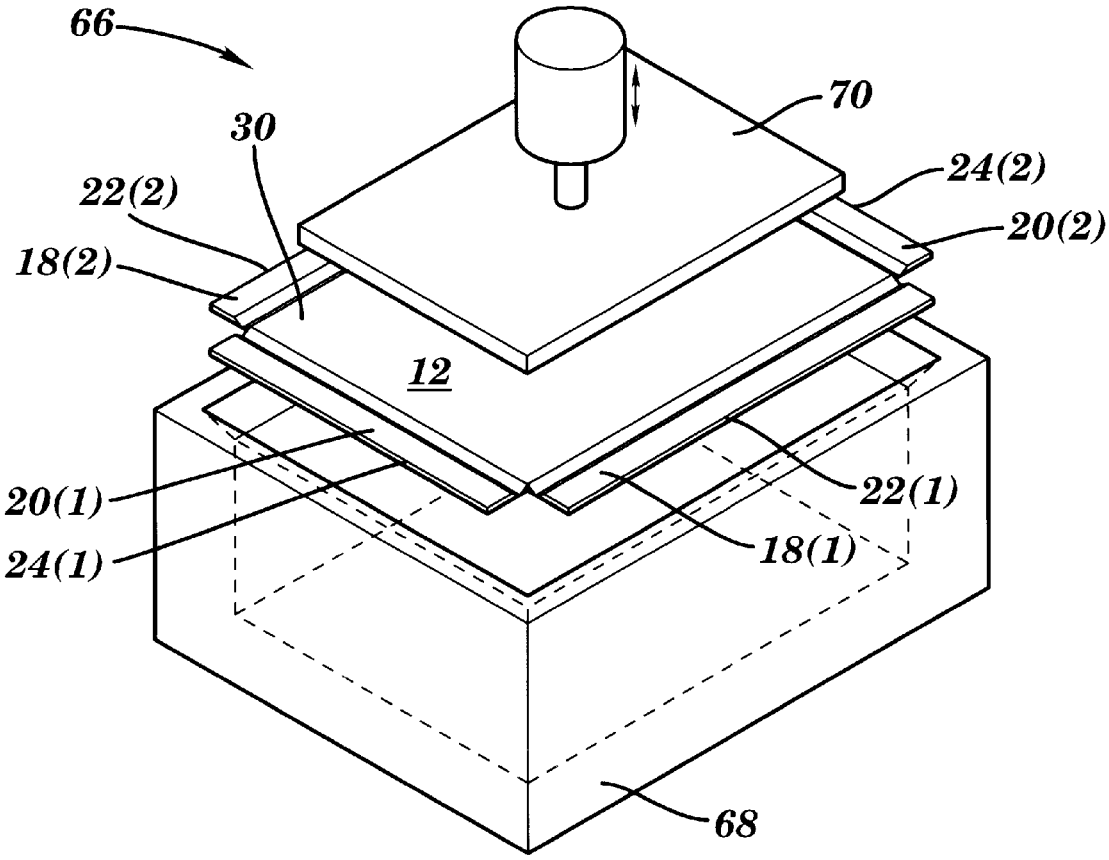
FIG. 4A is a perspective view of the sheet of material during a folding step in accordance with one embodiment of the present invention
Figure 4B:
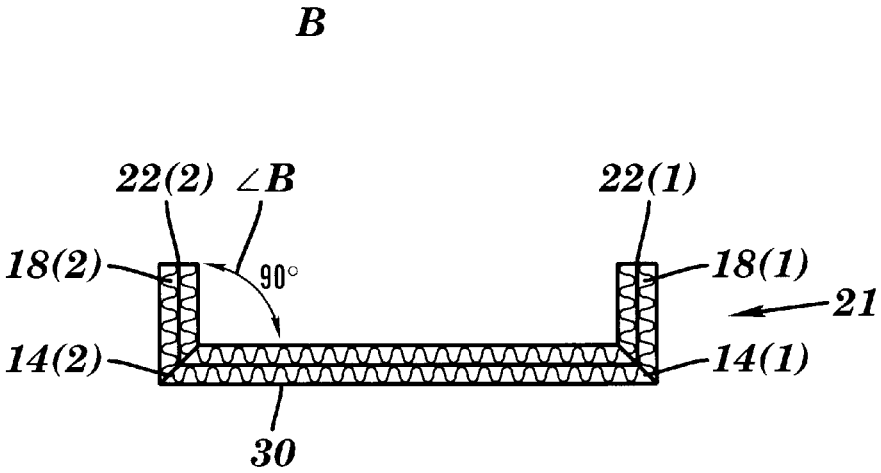
FIG. 4B is a cross-sectional view of the sheet of material following the folding step shown in FIG. 4A.

Referring to FIGS. 2A, 2B, and 4B, the sheet of material 12 has a first pair of grooves 14(1) and 14(2) which are each spaced from a first pair of edges 22(1) and 22(2) to define a first pair of sides or side walls 18(1) and 18(2). The sheet of material 12 also has a second pair of grooves 16(1) and 16(2) which are each spaced from a second pair of edges 24(1) and 24(2) to define a second pair of sides or side walls 20(1) and 20(2). The first and second pairs of grooves 14(1), 14(2), 16(1), and 16(2) are cut at an angle A which is larger than the angle B for the final position of the first and second pairs of side walls 18(1), 18(2), 20(1), and 20(2) to accommodate for the space taken up by an adhesive 44 located in the first and second pairs of grooves 14(1), 14(2), 16(1), and 16(2) when the first and second pairs of sides 18(1), 18(2), 20(1), and 20(2) are folded in. In this particular example, the first and second pairs of grooves 14(1), 14(2), 16(1), and 16(2) are each cut to an angle A of about ninety-five degrees while the final position of the first and second pairs of sides 18(1), 18(2), 20(1), and 20(2) is at an angle B of about ninety degrees with respect to base 30 of the sheet of material 12 between the first and second pairs of grooves 14(1), 14(2), 16(1), and 16(2). Although in this particular embodiment the box 21 has four sides 18(1), 18(2), 20(1), and 20(2), the box 21 could have fewer or more sides and thus fewer or more corresponding grooves and the sides and grooves could be positioned and cut at different angles.

Figure 3B:
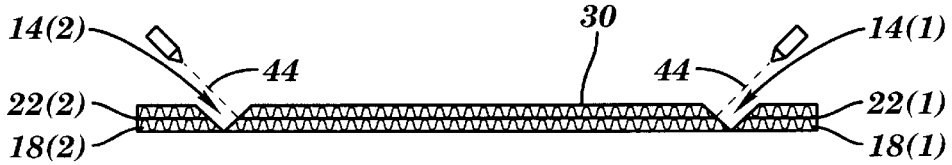
FIG. 3B is a cross-sectional view of the sheet of material during the gluing step shown in FIG. 3A.
Figure 3A:
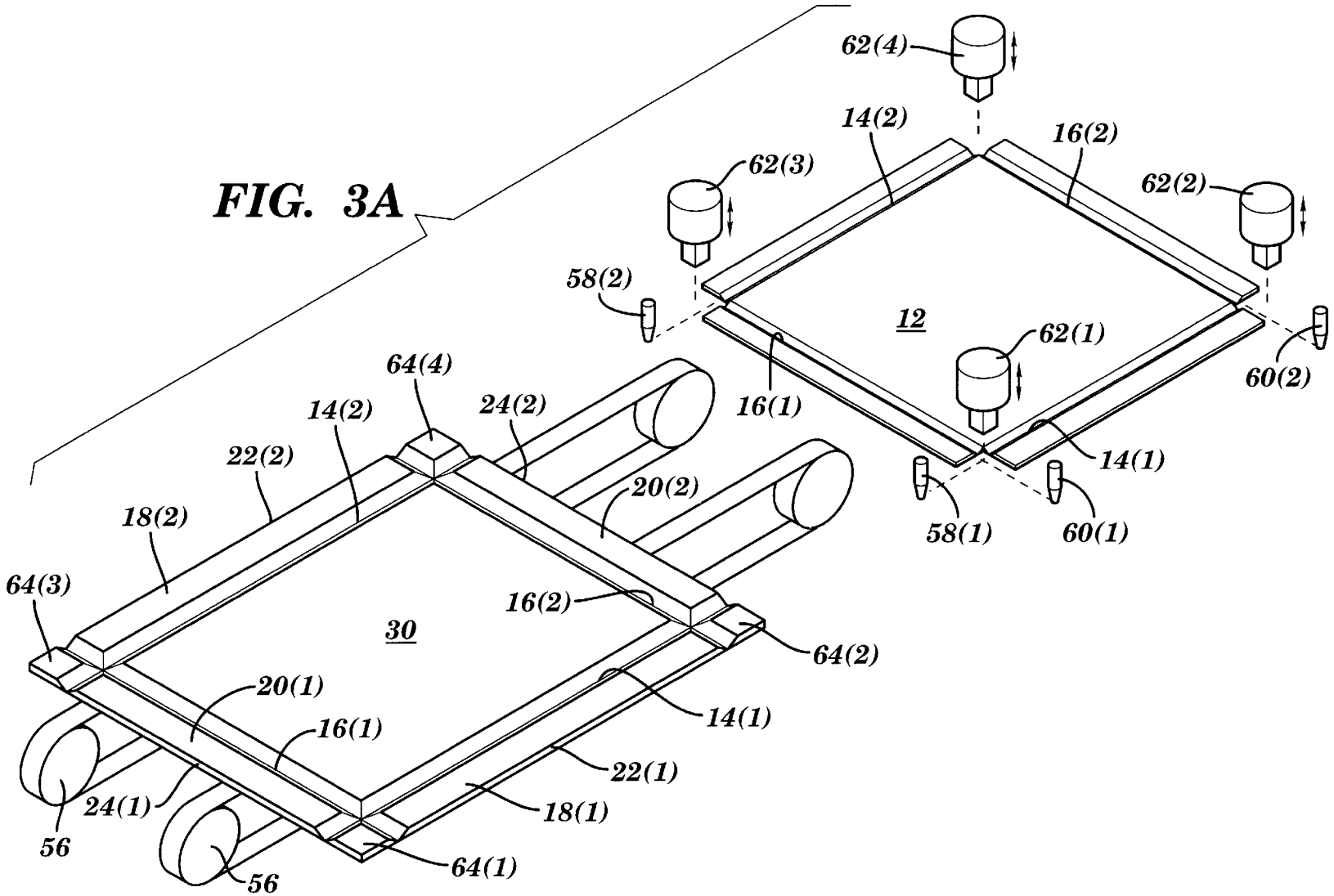
FIG. 3A is a perspective view of gluing and outside corner cutting steps in accordance with one embodiment of the present invention

Referring to FIGS. 3A and 3B, the first and second pairs of sides 18(1), 18(2), 20(1), and 20(2) of the box 21 are held together by an adhesive 44, although other types of securing devices and mechanisms, such as stripping paper could be used to hold the sides of the box 21 together. In this particular embodiment, the adhesive 44 is a hot melt glue, such as Fuller Co. Luna-Tack #P340K, or equivalent. Even though the first and second pairs of grooves 14(1), 14(2), 16(1), and 16(2) do not extend through the material, the grooves 14(1), 14(2), 16(1), and 16(2) may provide points in the material through which light can penetrate the box 21. To make the box 21 more light tight, the adhesive 44 is non-translucent, preferably tinted with a dark color such as black.

Figure 5:
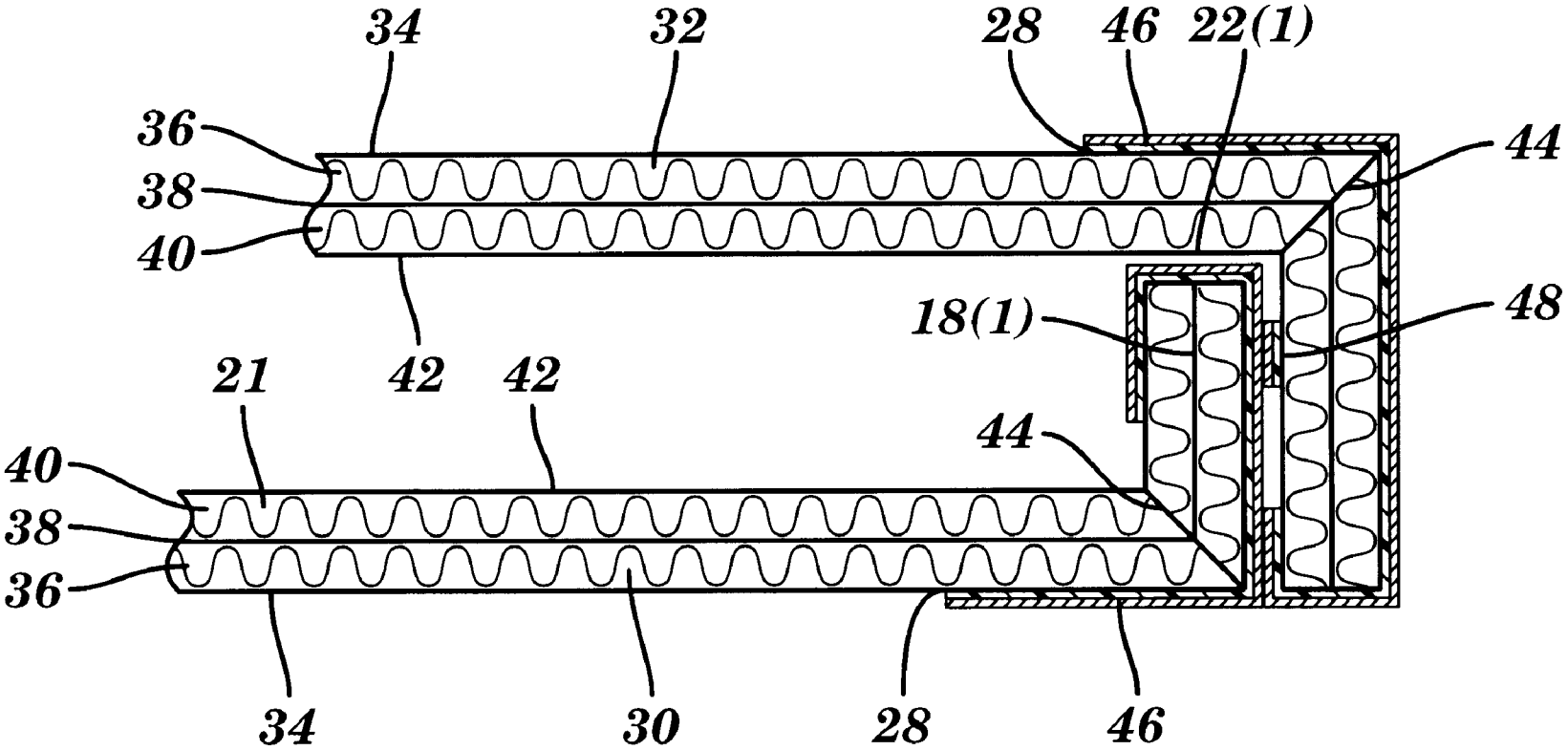
FIG. 5 is cross-sectional view of a portion of the box and lid after the step of applying first and second layers of material in accordance with one embodiment of the present invention.

Referring to FIG. 5, first and second layers of materials 28 and 46 are wrapped over the first and second pairs of edges 22(1), 22(2), 24(1), and 24(2) and around the bottom, outside corner of each of the first and second pairs of grooves 14(1), 14(2), 16(1), and 16(2). The first and second layers of material 28 and 46 add additional strength and rigidity to the box 21, as well as improving the aesthetic appearance by covering the exposed fluting at the first and second pairs of opposing edges 22(1), 22(2), 24(1), and 24(2) in the corrugated paper board and the bottom, outside corners of the first and second pairs of grooves 14(1), 14(2), 16(1), and 16(2). The first and second layers 28 and 46 also make the box more light tight by covering the bottom, outside corner of each of the first and second pairs of grooves 14(1), 14(2), 16(1), and 16(2). In this particular embodiment, the first layer of material 28 is a reinforcing layer, such as spun bound polyolefin sold as 105 white Tyvek ® and the second layer of material 46 is a stripping or lining layer, such as Kraft 45#/MSF. The dimensions of the first and second layers of material 28 and 46 are determined by the size of the box 21. Although in this particular embodiment, two layers of material 28 and 46 are shown the box 21 could have fewer or more layers as needed or desired. The box 21 also includes a spacer layer 48 which helps to provide a proper or snug fit between the box 21 and the lid 32.

Figure 6:
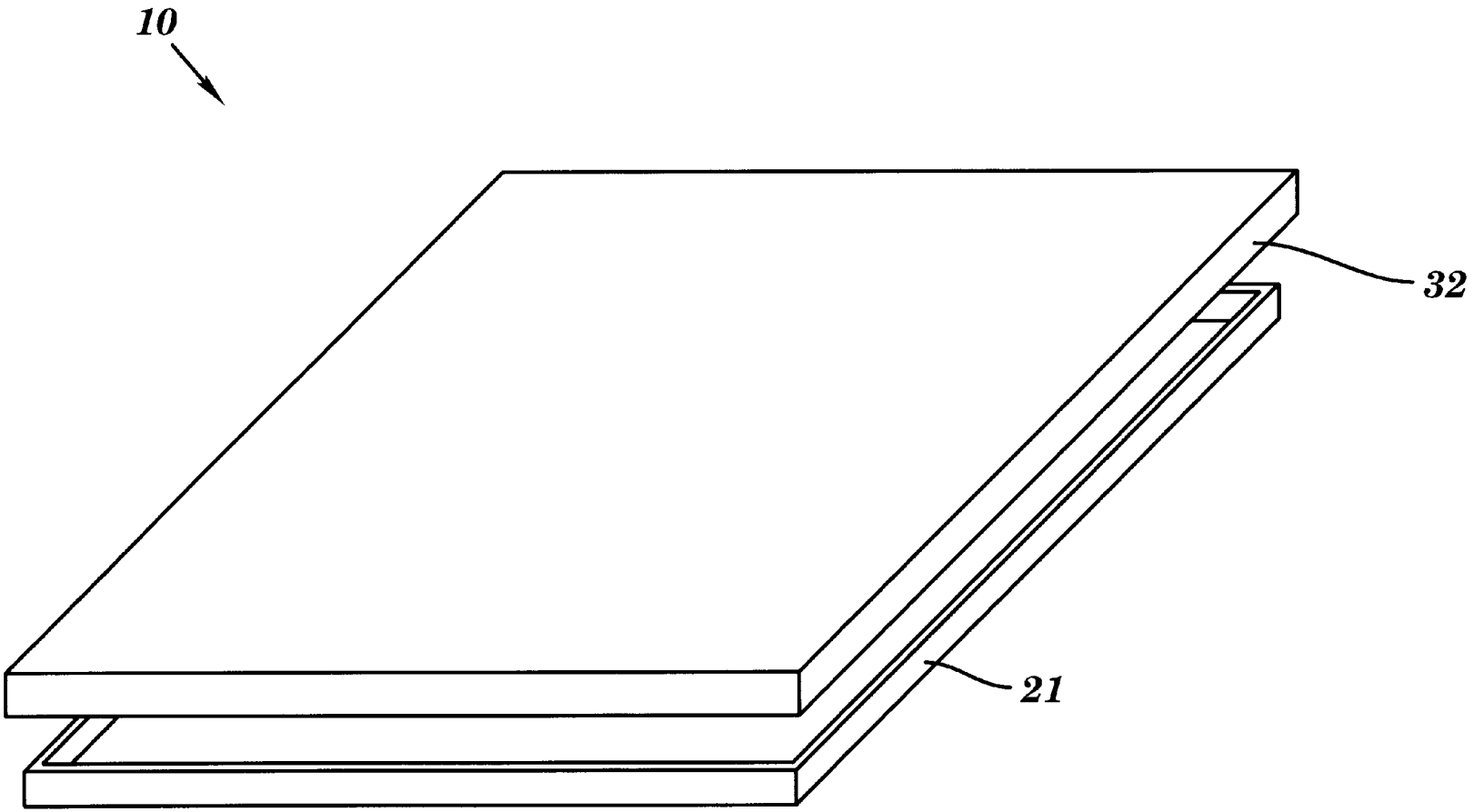
FIG. 6 is an exploded, perspective view of the box and the lid in accordance with one embodiment of the present invention

Referring to FIG. 6, the box 21 can have a variety of different dimensions and shapes depending upon the particular packaging application. In this particular embodiment, the inside dimensions of the base 30 which is located between the first and second pairs of grooves 14(1), 14(2), 16(1), and 16(2) ranges from about 16 5/16"×20 5/16" to 48 3/8"×64 3/8" width and length, and from 7/8" to 1 3/8" in depth. A manufacturing tolerance of ±1/16" is allowed on the inside dimensions, as long as the box 21 can be readily opened and remains 'light-tight' between 30% and 85% relative humidity when the lid 32 is placed over the box 21. The box 21 may have no more than ½" of warpage edge-to-edge as measured from a flat surface to the bottom of the sheet of material 12 at 40% relative humidity.

Referring back to FIGS. 1, 2A, and 2B, the method of making the box 21 or lid 32 begins with a sheet of material 12 which typically is received as flat sheets, stacked on a pallet. Preferably, the sheets of material 12 are corrugated paper board because it is a relatively strong and light weight packaging material. These sheets of corrugated paper board 12 are placed individually onto a conveyor 54 that carries the sheet of corrugated paper board 12 over blades 50(1) and 50(2)which cut out the first pair of opposing grooves 14(1) and 14(2) in the sheet of corrugated paper board 12 and blades 52(1) and 52(2) which trim the sides of sheet 12 to form the first pair of opposing edges 22(1) and 22(2) in the corrugated paper board 12. This grooving and trimming is all completed in the same step and can be done simultaneously, if needed or desired. Machinery which can run blades 50(1), 50(2), 52(1), and 52(2) is well known to those skilled in the art and thus will not be described here. The first pair of opposing sides 18(1) and 18(2) is defined between the first pair of opposing grooves 14(1) and 14(2) and the first pair of opposing edges 22(1) and 22(2) and the first inside dimension of the base 30 of the box 21 is defined between the first pair of grooves 14(1) and 14(2). With respect to the cutting grooves 14(1) and 14(2), care must be taken not to cut all the way through the sheet of corrugated paper board 12 through outer layer 34. Additionally as discussed earlier, the first pair of grooves 14(1) and 14(2) are cut out to define an angle A which is larger than the angle B for the final position of the first pair of sides 18(1) and 18(2) to accommodate for the space taken up by the adhesive 44 located in the first pair of grooves 14(1) and 14(2).

Once the first pair of grooves 14(1) and 14(2) and the first pair of opposing edges 22(1) and 22(2) have been cut and trimmed, the second pair of grooves 16(1) and 16(2) and the second pair of opposing edges 24(1) and 24(2) are cut and trimmed. In this particular embodiment, this is accomplished by rotating the sheet of corrugated paper board 12 about ninety degrees and readjusting the blades 50(1), 50(2), 52(1), and 52(2) for the second inside dimensions for the base 30 and the second pair of sides 20(1) and 20(2). In the same step, the conveyor 54 carries the sheet of corrugated paper board 12 over blades 50(1) and 50(2) which cut out the second pair of opposing grooves 16(1) and 16(2) in the sheet of corrugated paper board 12 and blades 52(1) and 52(2) which trim the sides to form the second pair of opposing edges 24(1) and 24(2) in the sheet of corrugated paper board 12. As discussed earlier, the second pair of grooves 16(1) and 16(2) are cut out to define an angle A which is larger than the angle B for the final position of the second pairs of sides 20(1) and 20(2) to accommodate for the space taken up by the adhesive 44 located in the second pair of grooves 16(1) and 16(2). At this point, the corrugated paper board has first and second pairs of grooves 14(1), 14(2), 16(1), and 16(2) and first and second pairs of sides 18(1), 18(2), 20(1), and 20(2).

One of the advantages of the present invention is that by trimming the sheet of corrugated paper board 12 in the same step as cutting the grooves, there is no need to worry whether or not the sheets of corrugated paper board 12 being used to form the boxes 21 all have precisely the same starting dimensions or whether the sheets of corrugated paper board 12 are properly aligned when loaded into the machine which cuts the grooves 14(1), 14(2), 16(1), and 16(2). The resulting grooved and trimmed sheets of corrugated paper boards 12 all have the same dimensions for the base 30 and the first and second pairs of side walls 18(1), 18(2), 20(1), and 20(2) enabling a higher quality, more precisely finished box 21 to be formed.

Referring to FIGS. 3A and 3B, the sheet of grooved and trimmed corrugated paper board 12 is placed on another conveyor which conveys the sheet of corrugated paper board 12 under glue heads 58(1) and 58(2) of an automatic gluing machine. Machinery to operate glue heads 58(1), 58(2), 60(1), and 60(2) is well known to those of ordinary skill in the art and thus will not be described here. The glue heads 58(1) and 58(2) are each positioned to apply a stream of adhesive 44, such as hot melt glue, into one of the first pair of grooves 14(1) or 14(2) in the sheet of corrugated paper board 12 along an inner edge. As discussed earlier, the adhesive 44 is non-translucent, preferably tinted with a dark color such as black, to help make the box 21 light-tight. After the adhesive 44 has been applied to the first pair of grooves 14(1) and 14(2), four corner cutters 62(1), 62(2), 62(3), and 62(4) are hydraulically actuated to cut out the four outside corners 64(1), 64(2), 64(3), and 64(4) from the sheet of corrugated paper board 12. Machinery to operate corner cutters 62(1), 62(2), 62(3), and 62(4) is well known to those of ordinary skill in the art and will not be discussed here. The sheet of corrugated paper board 12 is then placed on another conveyor (not shown) which conveys the sheet of corrugated paper board 12 under glue heads 60(1) and 60(2) of the automatic gluing machine are each positioned to apply a stream of the adhesive 44 into the second pair of grooves 16(1) and 16(2) in the sheet of corrugated paper board 12 along an inner edge.

Applying the adhesive 44 along an inner edge of each of the first and second pairs of grooves 14(1), 14(2), 16(1), and 16(2) is critical to the quality of joint strength attained when the first and second pairs of opposing sides 18(1), 18(2), 20(1), and 20(2) are folded in to make the box 21 or lid 32. The steps of applying, the adhesive 44 to the first and second pairs of grooves 14(1), 14(2), 16(1), and 16(2) and cutting out the four outside corners 64(1), 64(2), 64(3), and 64(4) can be completed in any order and can be all done in one step, if needed or desired.

Referring to FIGS. 4A and 4B, after the adhesive 44 has been applied and the outside corners 64(1), 64(2), 64(3), and 64(4) have been cut out, the sheet of corrugated paper board 12 is moved into a folding frame 66. In this particular embodiment, the folding frame 66 includes a rectangularly-shaped chute 68 which has inner dimensions which are substantially the same as the outer dimensions of the finished box 21 or lid 32 and a ram 70 which has outer dimensions substantially the same as the inner dimensions of the box 21 or lid 32. The folding frame 66 is preset to simultaneously fold all four of the first and second pairs of opposing sides 18(1), 18(2), 20(1), and 20(2) up to a ninety degree angle with respect to the base 30 by driving the ram in 70 into the base 30 of the sheet of corrugated paper board 12 to force the corrugated paper board 12 into the top opening of chute 68. The first and second pairs of opposing sides 18(1), 18(2), 20(1), and 20(2) are held up in position until the adhesive 44 in the first and second pairs of grooves 14(1), 14(2), 16(1), and 16(2) has time to set to secure the sides 18(1), 18(2), 20(1), and 20(2) together. In this particular embodiment, the chute 68 of the folding frame 66 has capacity for stacking five or six boxes or trays to provide the adhesive 44 time to set before being discharged out of a bottom opening in chute 68.

Referring to FIG. 5, once the first and second opposing sides 18(l), 18(2), 20(1), and 20(2) are folded up, then first and second layers of material 28 and 46 are applied over the first and second pairs of opposing edges 22(1), 22(2), 24(1), and 24(2) and also around the bottom corner of each of the first and second pairs of grooves 14(1), 14(2), 16(1), and 16(2) with the adhesive 44. As discussed earlier, the first layer 28 is a reinforcing layer and the second layer 46 is a stripping or lining layer. Although two layers of material 28 and 46 are shown, the box 21 or lid 32 could have fewer layer or more layers as needed or desired. To ensure a snug fit an optional spacer layer 48 may be added to sides 18(1), 18(2), 20(1), and 20(2) to properly position the sides of the box 21 from the sides of the lid 32 when nested together. The first and second layers of material 28 and 46 seal open areas of the sheet of corrugated paper board 12, such as the first and second opposing edges 22(1), 22(2), 24(1), and 24(2), from moisture and dust, enhance the aesthetic or cosmetic appearance of the box 21, aid in satisfying the 'light-tight' requirements, and add strength to the grooved/glued joints. Various matching or contrasting colors for the first and second layers of material 28 and 46 are used depending on customer requirements.

As discussed earlier, the same procedure is also followed to make the lid 32 for the box 21, except that the lid 32 has larger dimensions to allow the box 21 to nest within the lid 32. The completed box 21 and lid 32 for this particular embodiment are illustrated in FIG.6.

Having thus described the basic concept of the invention, it will be rather apparent to those skilled in the art that the foregoing detailed disclosure is intended to be presented by way of example only, and is not limiting. Various alternations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A method of making a box comprising:

providing a sheet of material;

trimming the sheet of material to form a first pair of opposing edges;

grooving the sheet of material to form a first pair of grooves, each of the first pair of grooves being spaced from one of the first pair of edges to form a first pair of sides, wherein the steps of trimming to form a first pair of opposing edges and grooving to form a first pair of grooves are done in the same step;

trimming the sheet of material to form a second pair of opposing edges;

grooving the sheet of material to form a second pair of grooves, each of the second pair of grooves being spaced from one of the second pair of edges to form a second pair of sides, wherein the steps of trimming to form a second pair of opposing edges and grooving to form a second pair of grooves are done in the same step;

a base defined between the first and second pairs of grooves, wherein the angle of each of the first and second pairs of sides with respect to the base is less than the angle at which the first and second pair of grooves are cut; and folding the first and second pairs of sides in along the first and second pair of grooves and securing them together to form the box.

2. The method according to claim 1 further comprising applying a first layer of material over the first and second opposing edges.

3. The method according to claim 2 further comprising applying a second layer of material over the first and second opposing edges.

4. The method according to claim 1 wherein the first and second pairs of sides are secured together by first applying an adhesive made of a non-translucent material to the first and second grooves.

5. The method according to claim 1 further comprising cutting outside corners of the sheet of material before folding the first and second pairs of sides up.

6. The method according to claim 1 wherein the sheet of material comprises corrugated paper board.

7. A method of making a light tight box comprising:

providing a sheet of material with a first pair of opposing edges and a second pair of opposing edges;

grooving the sheet of material to form a first pair of grooves, each of the first pair of grooves being spaced from one of the first pair of edges to form a first pair of sides;

grooving the sheet of material to form a second pair of grooves, each of the second pair of grooves being spaced from one of the second pair of edges to form a second pair of sides;

applying a non-translucent adhesive along each of the first and second pair of grooves; and folding the first and second pairs of sides in along the first and second pair of grooves to form the box.

8. The method according to claim 7 further comprising applying a first layer of material over the first and second opposing edges.

9. The method according to claim 8 further comprising applying a second layer of material over the first and second opposing edges.

10. The method according to claim 7 further comprising a base defined between the first and second pairs of grooves, wherein the angle of each of the first and second pairs of sides with respect to the base is less than the angle at which the first and second pair of grooves are cut.

11. The method according to claim 7 further comprising cutting outside corners of the sheet of material before folding the first and second pairs of sides up.

12. The method according to claim 7 wherein the sheet of material comprises a filler layer between an inner layer and an outer layer and wherein the first and second pairs of grooves extend through the inner layer and at least partially through the filler layer.

13. A method of making a box comprising:

providing a sheet of material with a first pair of opposing edges and a second pair of opposing edges;

grooving the sheet of material to form a first pair of grooves, each of the first pair of grooves being spaced from one of the first pair of edges to form a first pair of sides;

grooving the sheet of material to form a second pair of grooves, each of the second pair of grooves being spaced from one of the second pair of edges to form a second pair of sides;

a base defined between the first and second pairs of grooves, wherein the angle of each of the first and second pairs of sides with respect to the base is less than the angle at which the first and second pair of grooves are cut;

folding the first and second pairs of sides in along the first and second pair of grooves and securing them together; and applying a first layer of material at least partially over the first and second opposing edges.

14. The method according to claim 14 further comprising applying a second layer of material over the first and second opposing edges.

15. The method according to claim 14 wherein the first layer of material is a layer of reinforced material and the second layer of material is stripping paper.

16. The method according to claim 13 further comprising cutting outside corners of the sheet of material before folding the first and second pairs of sides up.

17. The method according to claim 13 wherein the sheet of material comprises corrugated paper board.

18. A method of making a package comprising:

providing a sheet of material with a first pair of opposing edges and a second pair of opposing edges;

grooving the sheet of material to form a first pair of grooves, each of the first pair of grooves being spaced from one of the first pair of edges to form a first pair of sides;

grooving the sheet of material to form a second pair of grooves, each of the second pair of grooves being spaced from one of the second pair of edges to form a second pair of sides;

applying an adhesive along each of the first and second pair of grooves; and folding the first and second pairs of sides in along the first and second pair of grooves to form the package, wherein the grooves in the sheet of material are cut to have a first angle which is greater than a second angle between each of the first and second pairs of sides and a base of the package when the first and second pairs of sides are folded in.

19. A box comprising:

a sheet of material with a first pair of opposing edges and a second pair of opposing edges;

a first pair of grooves in the sheet, each of the first pair of grooves spaced from one of the first pair of opposing edges to form a first pair of opposing sides;

a second pair of grooves in the sheet, each of the second pair of grooves spaced from one of the second pair of opposing edges to form a second pair of opposing sides; and a non-translucent adhesive located in the first and second pair of grooves, the non-translucent adhesive holding the first and second pairs of opposing sides together to form the box.

20. The box according to claim 19 further comprising a first layer of material located over the first and second opposing edges.

21. The box according to claim 20 further comprising a second layer of material over the first and second opposing edges.

22. The box according to claim 19 further comprising a base defined between the first and second pairs of grooves, wherein the angle of each of the first and second pairs of opposing sides with respect to the base is less than the angle at which the first and second pair of grooves are cut.

23. The box according to claim 19 wherein the sheet of material comprises a filler layer between an inner layer and an outer layer and wherein the first and second pairs of grooves extend through the inner layer and at least partially through the filler layer.

24. The box according to claim 19 wherein the sheet of material comprises a first filler layer between an inner layer and a middle layer and a second filler layer between the middle layer and an outer layer, wherein the first and second pairs of grooves extend through the inner layer, first filler layer, middle layer, second filler layer, and at least partially through the outer layer.

25. A box comprising:

a sheet of material with a first pair of opposing edges and a second pair of opposing edges, the sheet of material comprising a filler layer between an inner layer and an outer layer;

a first pair of grooves in the sheet, each of the first pair of grooves spaced from one of the first pair of opposing edges to form a first pair of opposing sides;

a second pair of grooves in the sheet, each of the second pair of grooves spaced from one of the second pair of opposing edges to form a second pair of opposing sides, wherein the first and second pairs of grooves extend through the inner layer and at least partially through the filler layer;

a securing device used to hold the first and second pairs of opposing sides together to form the box; and a first layer of material located over at least a portion of the first and second opposing edges.

26. The box according to claim 25 further comprising a second layer of material over the first and second opposing edges.

27. The box according to claim 26 wherein the first layer of material is a layer of reinforced material and the second layer of material is stripping paper.

28. The box according to claim 25 further comprising a base defined between the first and second pairs of grooves, wherein the angle of each of the first and second pairs of sides with respect to the base is less than the angle at which the first and second pair of grooves are cut.

29. The box according to claim 25 wherein the securing device is an adhesive made of a non-translucent material.

30. A box comprising:

a sheet of material with a first pair of opposing edges and a second pair of opposing edges, the sheet of material comprising a first filler layer between an inner layer and a middle layer and a second filler layer between the middle layer and an outer layer;

a first pair of grooves in the sheet, each of the first pair of grooves spaced from one of the first pair of opposing edges to form a first pair of opposing sides;

a second pair of grooves in the sheet, each of the second pair of grooves spaced from one of the second pair of opposing edges to form a second pair of opposing sides, wherein the first and second pairs of grooves extend through the inner layer, first filler layer, middle layer, and at least partially through the second filler layer;

a securing device used to hold the first and second pairs of opposing sides together to form the box; and a first layer of material located over at least a portion of the first and second opposing edges.

31. A box comprising:

a sheet of material with a first pair of opposing edges and a second pair of opposing edges;

a first pair of grooves in the sheet, each of the first pair of grooves spaced from one of the first pair of opposing edges to form a first pair of opposing sides;

a second pair of grooves in the sheet, each of the second pair of grooves spaced from one of the second pair of opposing edges to form a second pair of opposing sides, wherein the first and second pair of grooves are cut at an angle between about ninety-two degrees to one-hundred degrees; and an adhesive located in the first and second pair of grooves, the adhesive holding the first and second pairs of opposing sides together to form the box.

32. The box according to claim 31 further comprising a first layer of material located over the first and second opposing edges.

33. The box according to claim 32 further comprising a second layer of material over the first and second opposing edges.

34. The box according to claim 31 wherein the sheet of material comprises a filler layer between an inner layer and an outer layer and wherein the first and second pairs of grooves extend through the inner layer and at least partially through the filler layer.

35. The box according to claim 31 wherein the sheet of material comprises a first filler layer between an inner layer and a middle layer and a second filler layer between the middle layer and an outer layer, wherein the first and second pairs of grooves extend through the inner layer, first filler layer, middle layer, second filler layer, and at least partially through the outer layer.

* * * * *